United States Patent [19]

Hochanadel et al.

[11] Patent Number: 4,543,864

[45] Date of Patent: Oct. 1, 1985

[54] STACKING CONVEYOR FOR PRODUCT SLICING MACHINE

[75] Inventors: Thomas A. Hochanadel, Pickerington; Robert J. McInerney, Columbus, both of Ohio

[73] Assignee: J. E. Grote Company, Blacklick, Ohio

[21] Appl. No.: 540,196

[22] Filed: Oct. 7, 1983

[51] Int. Cl.[4] ..... B26D 7/06

[52] U.S. Cl. ..... 83/91; 83/155.1; 83/703; 83/409.2; 83/411 A; 83/733; 83/79

[58] Field of Search ..... 83/91, 92, 155, 155.1, 83/703, 409.1, 409.2, 411 R, 411 A, 425, 79, 733

[56] References Cited

U.S. PATENT DOCUMENTS

| | | | |
|---|---|---|---|
| 3,505,918 | 4/1970 | Schneider | 83/112 |
| 3,834,259 | 9/1974 | Kuuhler | 83/155.1 |
| 4,026,421 | 5/1977 | Lotz | 83/91 |
| 4,369,682 | 1/1983 | Bunnell | 83/112 |
| 4,436,012 | 3/1984 | Hochanadel | 83/703 |

*Primary Examiner*—James M. Meister
*Assistant Examiner*—John L. Knoble
*Attorney, Agent, or Firm*—Robert E. Stebens

[57] ABSTRACT

A stacking conveyor is provided for receiving thin product slices moving along a horizontal path and placing a plurality of slices in stacks of predetermined configuration. One embodiment of the stacking conveyor includes a conveyor belt carried on a fixed position frame and is oscillated to receive a predetermined number of slices forming a stack and then revolved to discharge the formed stack. A second embodiment of the stacking conveyor includes a conveyor belt carried on a movable frame that is reciprocated to receive a slice while moving in one direction and then discharging the slice while moving in the opposite direction. Each of the two embodiments is adapted to be mechanically coupled with an apparatus forming the slices to either revolve the conveyor belt or to displace the conveyor belt at the same speed as the slice being received.

8 Claims, 13 Drawing Figures

STACKING CONVEYOR FOR PRODUCT SLICING MACHINE

FIELD OF THE INVENTION

This invention relates in general to food packaging and in particular it relates to the packaging of sliced food products such as cheese or meats. More specifically, this invention relates to a stacking conveyor and a method of forming stacks of sliced food products into vertically aligned stacks of a predetermined number of slices for incorporation into sales packages.

BACKGROUND OF THE INVENTION

Many food products are packaged for retail sales in the form of prepackaged units of specified numbers of slices of the food product. Cheese and processed meat products are major examples of food products which are marketed in this manner. The packages are of a type which are fully sealed for protection of the contents during prolonged periods of storage and while on display in a retail store for selection by the customers.

Slicing machines have been devised and are commonly utilized in the food product industry to produce the sliced food products. While these machines are effective in producing the food product slices of a predetermined thickness, there still remains the procedural step of assembling those slices into a stacked group that may be readily placed into a packaging unit. It is highly desirable to fully automate the slicing and packaging operations to minimize the necessity of hand labor not only because of the cost, but for purposes of sanitation and meeting of regulations governing the processing and handling of food products for human consumption. Such automated systems in general comprise a slicing mechanism which is positioned in operative relationship to a packaging system.

In a typical system, a slicing machine cuts the food product into a number of slices in a single operation and the block of slices are then transferred to the packaging system where the block of slices is wrapped. Alternatively, slices are formed in a series and each of the slices is then wrapped and the wrapped slices are then assembled into a stack that is also wrapped as a unit.

While these previously devised systems and apparatus have been found adequate for merely effecting slicing and packaging of food products such as cheese, there are many food product processing operations were these systems and apparatus are either incapable of performing the desired operation or they are of undesirably slow functioning to meet economic operating standards. As a consequence, many food processes continue to utilize manual operations. One example is the packaged and frozen dinner in which food product slices are frequently applied to other food products such as a cheese slice applied over a meat or vegetable item. This operation has remained a manual operation with a worker applying the cheese slice to each conveyor transported container as it moves past the operator's station.

SUMMARY OF THE INVENTION

In accordance with this invention, a stacking conveyor is provided to collect or receive slices produced by a slicing machine which moves the food product during the slicing operation with the slice having a horizontal motion during the slicing operation as well as a downward displacement as it falls from the slicing machine. One slicing machine of this type is frequently described as a pendulum slicer, although this invention is not limited in its use to that single type of slicing machine although that type of machine is shown and described in combination with the stacking conveyor of this invention. Two embodiments of the stacking conveyor are illustrated and described with each embodiment operable to receive a horizontally moving slice and capable of forming a stack of a predetermined number of slices and then discharging the stack of slices onto a receiver or to alternatively receive the slices as they are formed and to then serially deposit the slices on a receiver in a stacked relationship. Each of the embodiments may be operated to either stack the slices vertically or to place the predetermined slices in a partially overlapped, layered or shingled-type arrangement.

The stacking conveyors of this invention are particularly designed for utilization with a product slicing machine of the type having a pendulum product carrier which moves the unsliced product relative to a slicing blade. Operation of a slicing machine of this type is of an oscillatory motion which results in the product slice being formed at a same fixed location. Since the slice is also travelling horizontally at a predetermined speed during the time that it is being formed, it is difficult to merely form stacks of slices by such a slicing machine through gravity operation without also providing means for accommodating the horizontal movement of the product slice as it is formed. Thus, the stacking conveyor being oscillated in timed relationship to the operation of the slicing machine results in this desired accommodation of the horizontal movement of the slice and enables the combination to form the desired stacks of aligned or layered slices.

One embodiment of the stacking conveyor includes an endless belt-type of conveyor which is carried on a frame that is supported in fixed relationship to the structural frame of the slicing mechanism. A mechanical interconnection is provided between the slicing mechanism and the stacking conveyor to produce the oscillatory movement of an upper run of the conveyor belt in either timed or relatively stationary relationship to the slicing machine during a slice forming and stacking operation. Once a predetermined number of slices have been formed into a desired stack, the mechanism of the stacking conveyor is operable to increment the conveyor to either an advanced position where the formed stack is retained while a second stack is formed or it may be immediately discharged into a waiting package container or other receiver which is propelled along a production conveyor in timed relationship to the horizontal movement of the stack being discharged. The apparatus includes mechanical drives and coupling mechanism such that the oscillatory drive is disabled during the time of incrementing the stacking conveyor by a separate drive mechanism. Suitable controls are provided to assure that a proper number of slices are formed in each stack and that the stacking conveyor is operated in timed relationship with respect to not only the slicing machine, but relative to the production conveyor carrying the packaging containers to form either a vertical or a layered-type stack.

A second embodiment of the stacking conveyor includes an endless belt-type conveyor carried on a supporting frame with the unit being mounted on a structural frame for reciprocating movement in relatively stationary relationship to the slicing machine to receive and collect food product slices as they are formed. A drive mechanism is provided for selectively revolving the stacking conveyor belt in discharge of a formed stack of slices or to alternatively serially discharge the slices onto a receiver transported on a production conveyor. The combination of the oscillatory movement of the conveyor and revolving of the conveyor belt enables this embodiment to discharge a slice or stack of slices onto a stationary receiver carried on a production conveyor. The stacking conveyor drive mechanism can be selectively operated to incremently advance the conveyor belt in forming of a layered stack of slices that are then subsequently discharged or to serially discharge slices to form a layered stack on a receiver carried on a production conveyor. As a further alternative, the stacking conveyor may be operated to serially discharge slices onto a receiver carried by a production conveyor that is incrementally advanced in timed relationship to the stacking conveyor to obtain a layered stack on the receiver.

These and other objects and advantages of this invention will be readily apparent from the following detailed description of illustrative embodiments of the apparatus and the accompanying drawings.

DESCRIPTION OF THE DRAWING FIGURES

DESCRIPTION OF THE ILLUSTRATIVE EMBODIMENT

Figure 1:
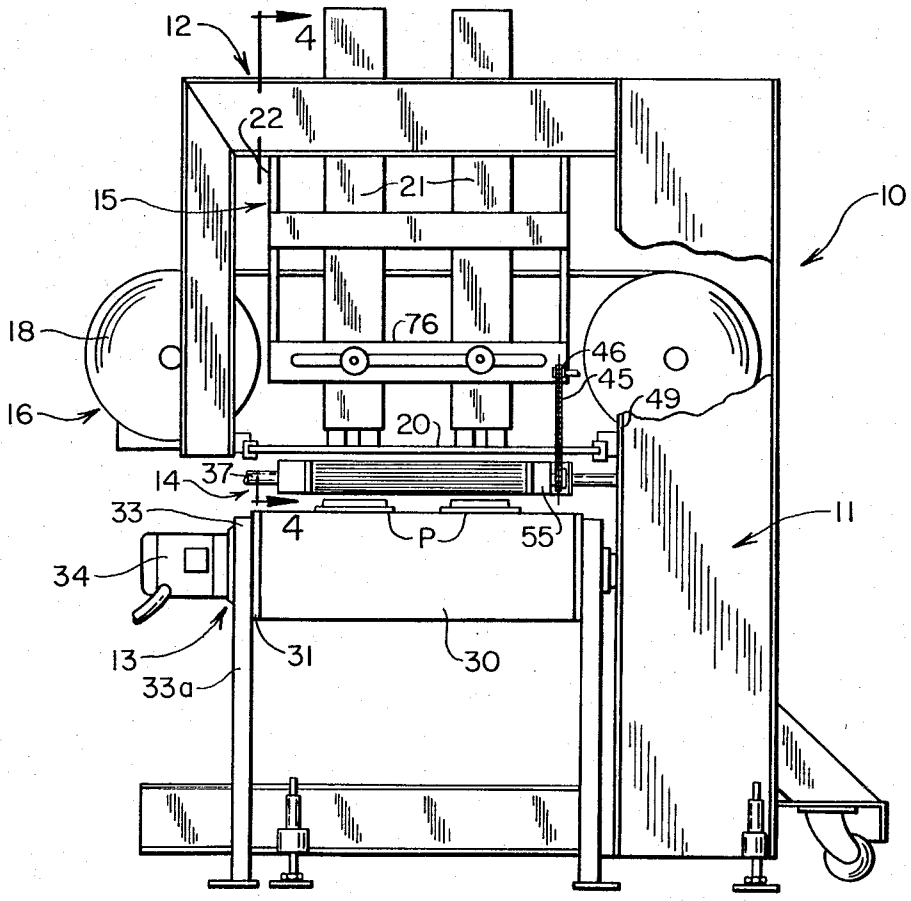
FIG. 1 is a front elevational view of the pendulum-type slicing machine provided with a first embodiment of a stacking conveyor of this invention and operatively associated with a production conveyor.
Figure 2:
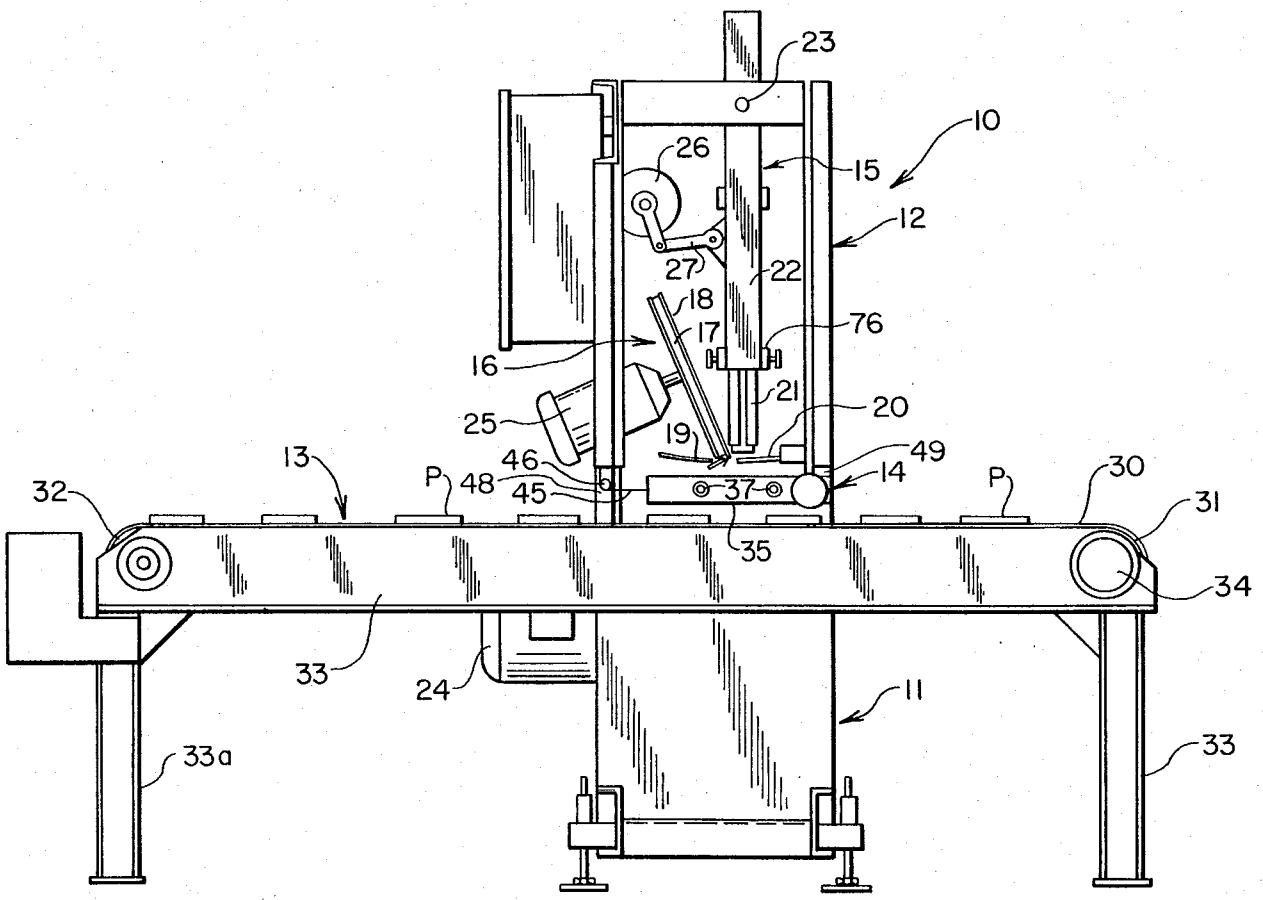
FIG. 2 is a left side elevational view thereof.
Figure 3:
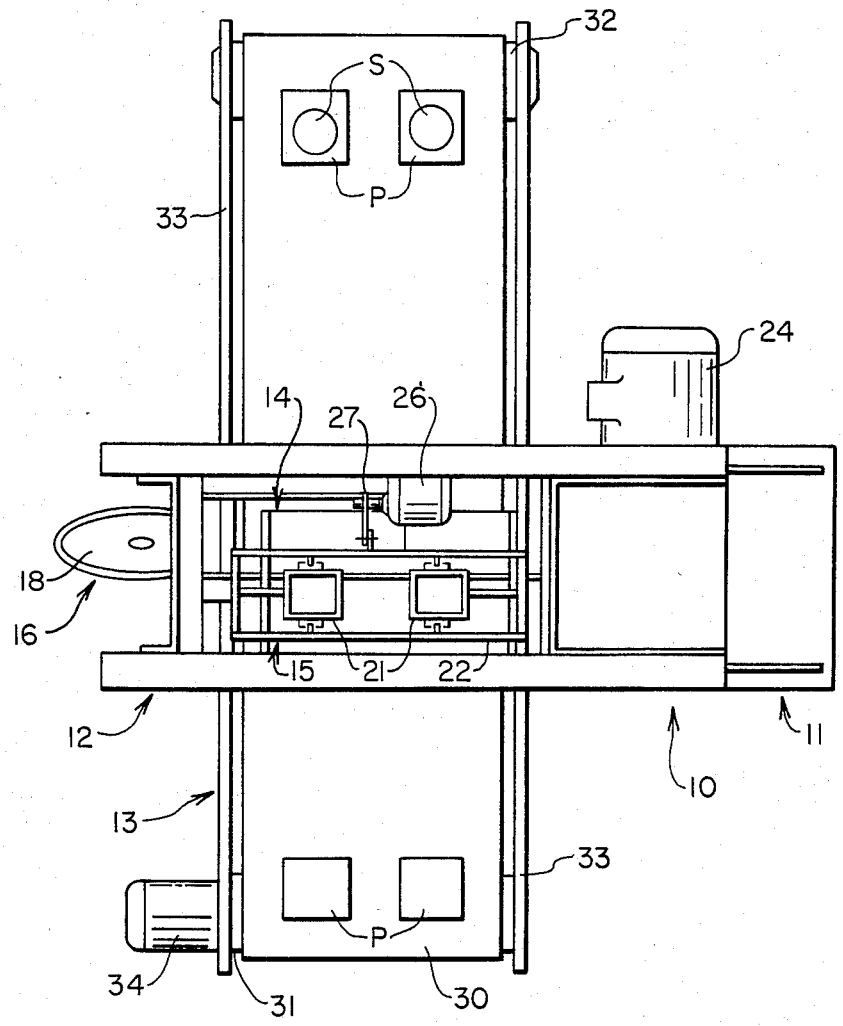
FIG. 3 is a top plan view with portions of the slicing machine broken away for clarity of illustration.

For illustration of the invention in an operating environment, the stacking conveyor system is shown in FIGS. 1, 2 and 3 associated with a specific type of food product slicing machine. This illustrative slicing machine is of a type which is generally described as a pendulum slicer and indicated generally by the numeral 10. A slicing machine of this type includes a structural frame 11 having a slicing head 12 carried by the frame in a cantilevered manner. This structural arrangement of the components enables the slicing machine to be readily positioned or removed from a conveying system or production conveyor such as that which is diagrammatically illustrated in the drawing figures and is designated generally by the numeral 13. Mounted on the structural frame 11 in operative relationship to the slicing head 12 and in underlying relationship thereto is a stacking conveyor 14 of this invention. The basic functional operation of the components thus illustrated and described with respect to FIGS. 1, 2 and 3 is that a food product is formed into thin slices that are gravity fed onto the stacking conveyor 14 where they are accumulated into stacks of predetermined number of slices. Once the stacks of slices of the desired number is accumulated, the stack is then discharged from the stacking conveyor onto the production conveyor 13 where, for purposes of illustration, they are deposited into packaging containers P.

The pendulum type slicing machine 10 is not illustrated or described as to all of its specific mechanical structural elements and details, but the major components are shown and described to the extent that the operation thereof will be clearly understood. The primary components of major significance to consider with respect to this invention reside in the slicing head 12. This slicing head, as indicated, projects in a cantilevered manner with respect to the structural frame 11 and its two basic components comprise a product carrier 15 and a blade type slicing mechanism 16. In the illustrative embodiment, the slicing mechanism 16 comprises an endless blade 17 trained around two supporting pulleys 18 to position a lower run of the blade in a generally horizontally extending plane and disposed in cooperative relationship to product support plates 19 and 20. Food products in the form of elongated sticks such as cheese or other forms of meat products are disposed in elongated vertically extending tubular product receivers which are included in the product carrier 15 with the food product being fed downwardly by gravity. The product carrier 15 includes a pendulum frame 22 which is mounted at its upper end on a pivot 23 for oscillatory swinging movement about a horizontal axis generally aligned with the longitudinal length of the slicing mechanism 16. The pendulum frame 22 with the product receivers mounted thereon may thus be swung in a vertical plane that is aligned with longitudinal axes of both the stacking and production conveyors 14, 13 to cause the lower ends of products extending from the receivers to sweep across the lower run of the endless blade 17 and sever a relatively thin slice from the food product. A function of the support plates 19 and 20 is to maintain the product within the receiver, although permitting extension of the product a desired distance to form a slice of predetermined thickness. One product support plate 20 is preferably mounted for relative adjustment to enable the thickness of the slice to be adjusted accordingly.

Operation of the slicing machine as illustrated and described is advantageously achieved through hydraulic drive mechanisms. Specifically, a pressurized hydraulic fluid source is internally provided in the structural frame of the machine and includes a fluid pump driven by an electric motor 24 and which hydraulic system is provided with appropriate operating controls and fluid pressure controls. Coupled in fluid communicating relationship with the pressurized fluid source is a hydraulic drive motor 25 mechanically coupled with one of the pulleys 18 supporting the slicing blade 17 and thus producing the revolution of that blade in performing slicing operations. A second hydraulic drive motor 26 is provided for effecting the oscillatory movement of the pendulum type product carrier 15. This drive motor 26 is coupled through a crank-type drive mechanism 27 to the product carrier, and thus, a rotational input drive is translated to a reciprocating or oscillatory movement with respect to the product carrier.

As previously indicated, structural details of the pendulum slicing machine are not illustrated in their entirety. However, the drawings do illustrate the pendulum type slicing machine as to its functional components and the operation and function thereof will be readily understood. In general, the food products are positioned in the respective product receivers with two such receivers being illustrated in this embodiment. Both receivers need not be used and alternatively, the number of such receivers may be increased if desired for the particular operating circumstances of a specific machine. With the food product positioned in the respective receivers, the hydraulic system is operated to energize the respective motors 25 and 26 which then revolve the slicing blade 17 and cause oscillation of the product carrier 15. Looking specifically at FIG. 2, it will be seen that the oscillatory movement of the product carrier 15 is cyclic between forward and relatively rearward positions. The length of the stroke is such that the entire bottom end of the food product in their respective receivers will fully traverse the bottom run of the slicing blade and thereby effect severing of the product slice. It will also be noted that the slicing blade 17 is mounted on the respective pulleys 18 in a manner as to be inclined upwardly and rearwardly as to the area of motion of the product carrier. This arrangement enables the product carrier to swing through a predetermined arc without interference as to the slicing blade and having the advantage that the slicing blade structure itself projects only upwardly relative to the cutting plane and thus also is out of interference with respect the forming of the slice or subsequent operations relative to the slices that are formed. The slicing machine may be operated through appropriate controls to cause the product carrier to oscillate at a predetermined rate and thus form the slices at a specific rate.

Figure 4:
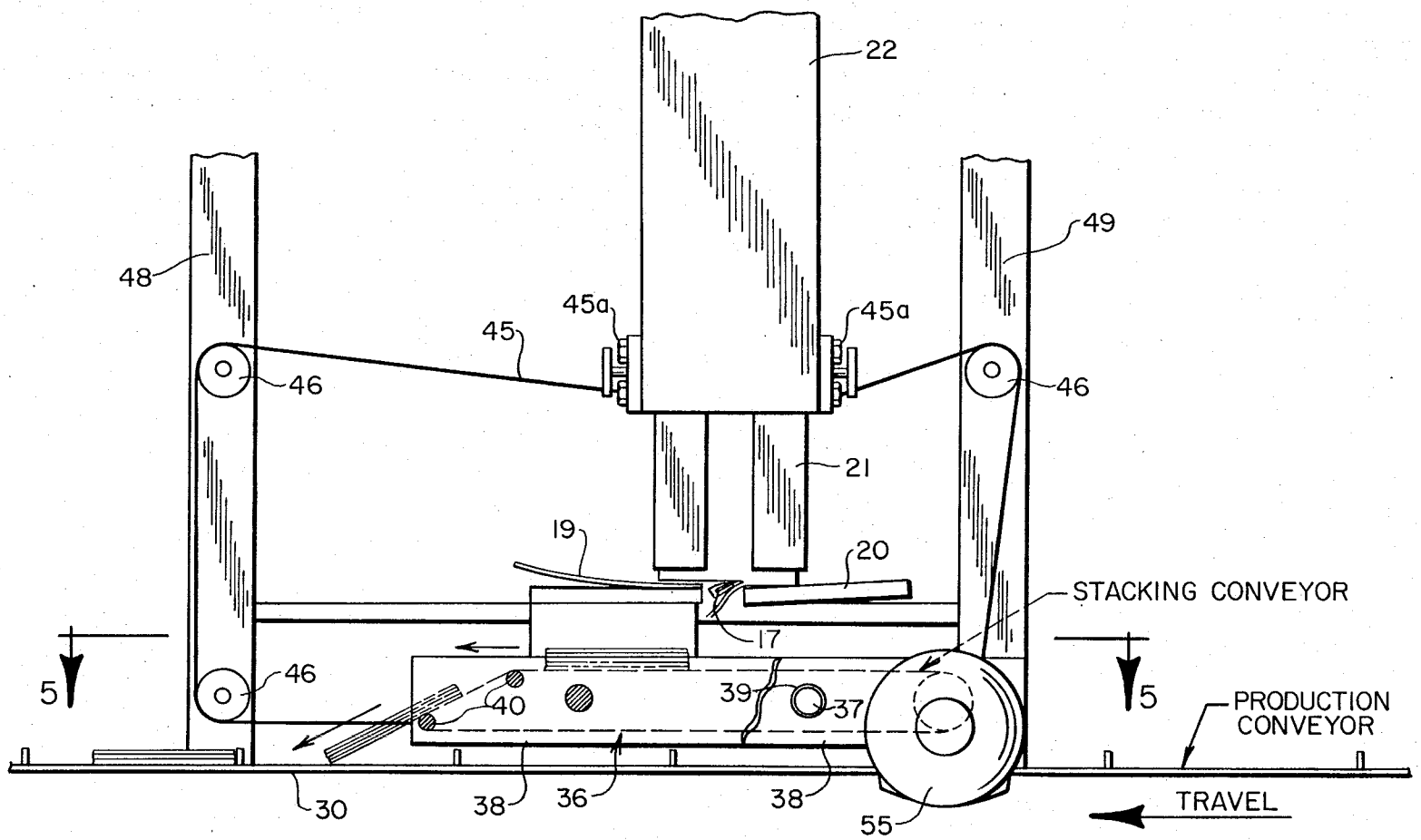
FIG. 4 is a fragmentary sectional view taken along line 4—4 of FIG. 1.
Figure 5:
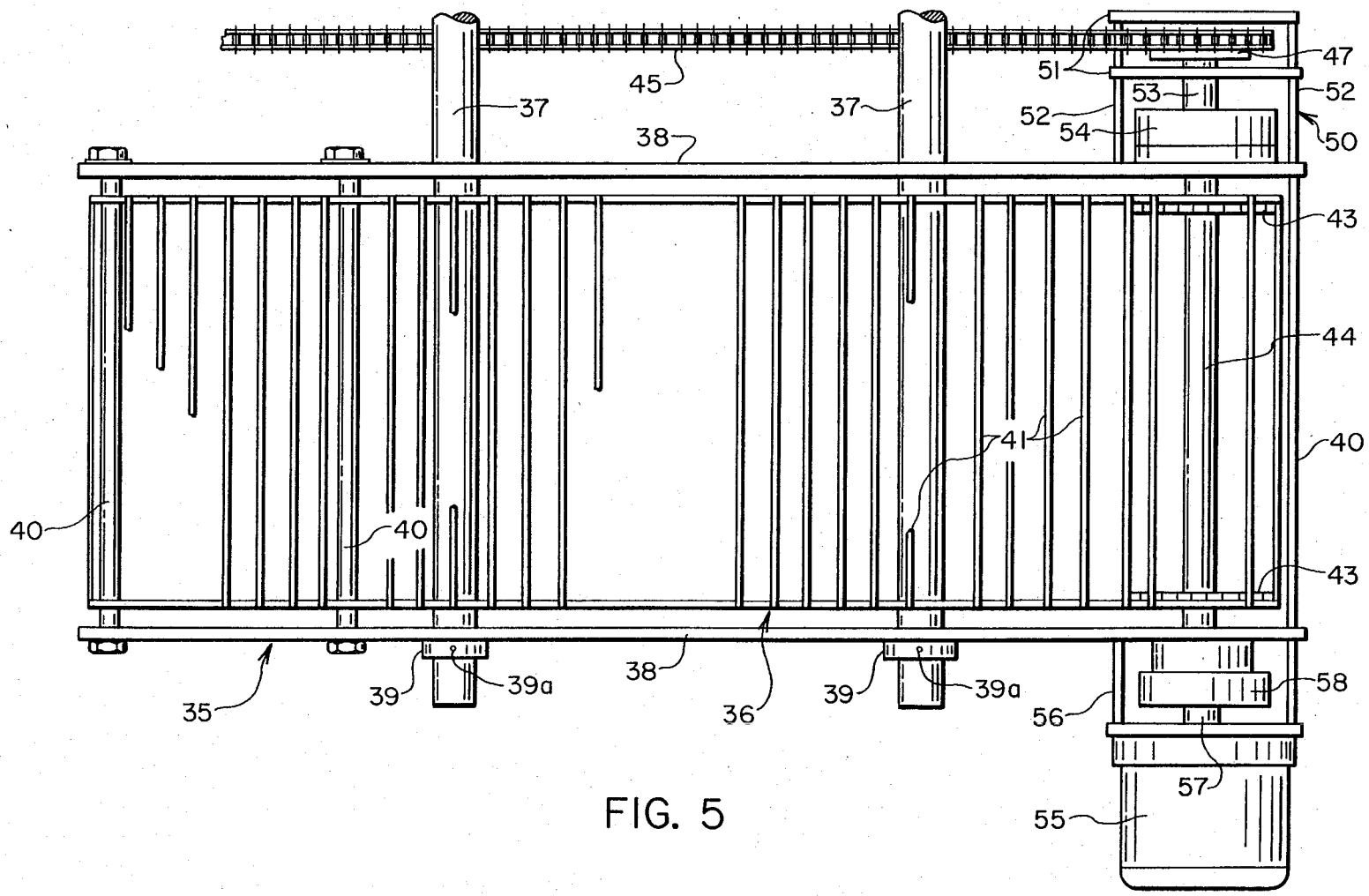
FIG. 5 is a fragmentary sectional view taken along line 5—5 of FIG. 4.
Figure 6:
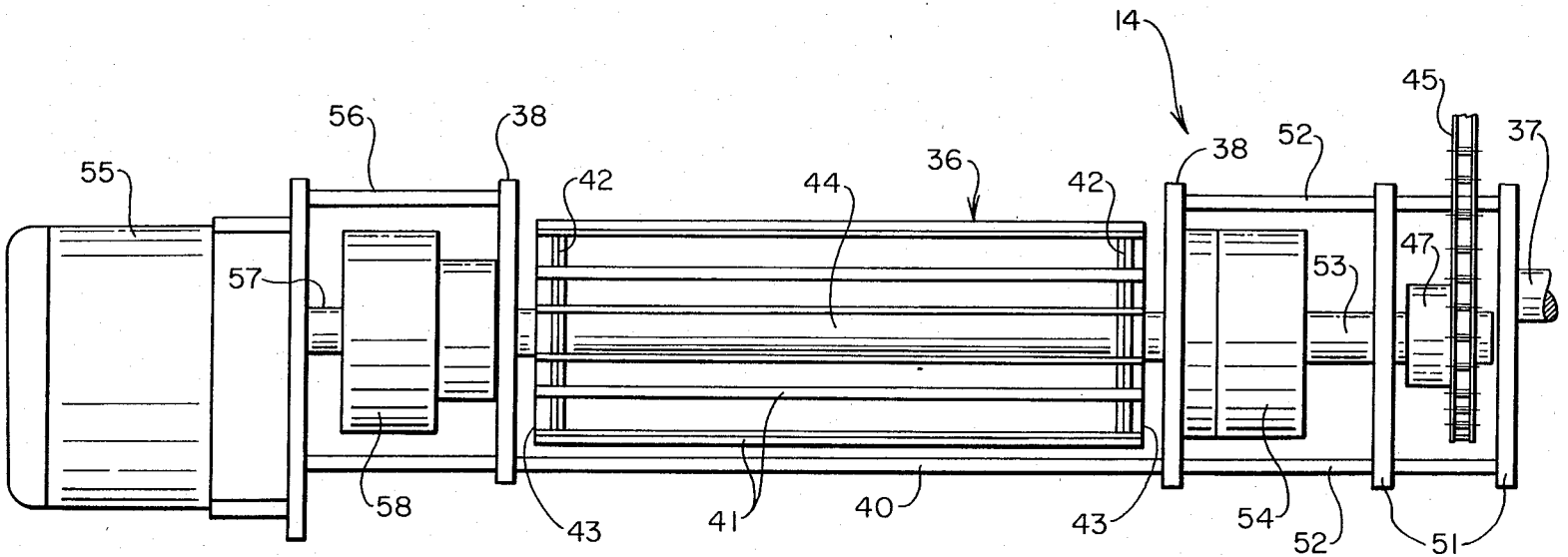
FIG. 6 is an end elevational view of the stacking conveyor as seen from the right side of FIG. 4.

It is a basic objective of the illustrative embodiment of the invention to form product slices into stacks of a predetermined number and to place these stacks into a receiving package unit P or onto a suitable receiver. For this purpose, a production conveyor 13 is shown that has the function of transporting packaging units P beneath the stacking conveyor 14 where they may be sequentially positioned to receive the stacks of product slices which are designated by the letter S as shown in FIG. 4. A relatively simplified conveyor 13 is shown as that is sufficient to illustrate the function of the mechanisms. Such a conveyor in a typical application includes an endless belt 30 trained around two rollers 31 and 32 which are carried by a supporting frame 33 which is independently supported on its own legs 33*a*. This supporting frame maintains the longitudinal spacing of the rollers 31 and 32 and may be provided with additional rollers or belt supporting plates to assure that the upper run of the belt will be maintained in a substantially horizontal plane. Driving of the belt 30 may be effected by an electric motor 34 and is provided with suitable controls to enable incremental advancement of the belt and the package units P that are carried on the upper run. Alternatively, the conveyor belt may be driven by a hydraulic powered drive motor where a greater degree of control is desired as to speed. The feeding of the package units P onto the conveyor belt 30 or mechanisms for subsequent operations on the package units and the discharge thereof from the belt 30 are not shown. However, for purposes of example, it will be understood that various automated mechanisms may be utilized for feeding of package units onto the conveyor in predetermined spaced relationship and that the packaging units may be subjected to further package forming operations either on the belt 30 or at a subsequent operating station, although none of such components are shown as they are not necessary for understanding the structure and functioning of this invention.

The pendulum type slicing machine 10 results in forming of the slices for gravity feed, although the slices are initially formed in a manner such that they are propelled in a generally horizontal direction. As a consequence of this type of slicing operation, where the slices are formed at a fixed point, the slices if permitted to merely drop as they are formed, would accumulate in a random pile totally unsuited for purposes of packaging. A pendulum type slicing machine or other type of machine for that matter which forms slices in this manner at a fixed point with the slices having a horizontal motion requires that appropriate mechanisms be provided to receive and convey or transport the slices as they are formed in a horizontal direction. It is for this purpose that the stacking conveyor 14 is provided and, in accordance with this invention, the stacking conveyor is formed with a structural frame 35 on which is supported a stacking conveyor belt 36. The stacking conveyor belt 36 is supported to extend in a generally horizontal plane and the mechanism itself is attached to and carried by the structural frame 11 of the slicing machine. Providing such structural attachment are a pair of elongated rods 37 which are rigidly fixed to a vertical supporting element of the slicing machine and extend horizontally outward therefrom in underlying relationship to the slicing head. The structural frame 35 of the stacking conveyor includes a pair of longitudinally extending side plates 38 that are provided with respective apertures through which the support rods 37 extend. Utilization of the support rods enables the stacking conveyor to be properly positioned laterally with respect to the slicing head for accurate positioning of the conveyor relative to the product receivers. Suitable connecting devices 39 such as annular flanges secured to the one side plate 38 are provided to mechanically interconnect the stacking conveyor in fixed position on the support rods as by means of set screws 39*a*.

Additional structural components of the stacking conveyor 14 include a plurality of spacing rods 40 that extend transversely between the elongated side plates 38 with three such rods being provided in the illustrative embodiment. The stacking conveyor belt 36 is of a wire rod type having the ends of the wire rods 41 configured to form interconnecting links that form respective endless belts 42 at each side of the conveyor. At one end of the conveyor, the belt 36 is trained around a pair of drive sprockets 43 mounted on a drive shaft 44 with the sprockets 43 respectively aligned with the endless link chain 42 at each side of the conveyor. The opposite end of the belt 36 is trained around two of the spacing rods 40 which are disposed in horizontally and vertically spaced relationship to result in forming of a downwardly inclined discharged end portion. Each of these two rods 40 is provided with a tubular sheath formed from plastic material exhibiting a low friction, long wearing characteristic which avoids having to provide a roller structure about which the conveyor belt may move. Referring to FIG. 4, it will be noted that the vertical spacing of the rods 40 is such that the belt 36 will be maintained in substantially parallel upper and lower runs in cooperation with the drive sprockets 43.

It is desired that the stacking conveyor be positioned to have the upper run thereof disposed in fairly close proximity to the bottom of the product carriers or the lower run of the slicing blade. By fairly close proximity, it is preferred that the spacing be of the order of one inch or less to assure that the slices will be properly aligned with respect to each other. Accordingly, with such close proximate positioning of the upper run of the conveyor to the slicing blade, the apparatus is designed for use in forming of relatively small stacks such as three or four slices of the order of 1/16–⅛ inch in thickness. This spacing is not critical and may be increased to an appropriate distance within reason to enable the apparatus to form stacks with a larger number of slices or of a larger total accumulated height. Keeping in mind that increasing the spacing will also tend to decrease the accuracy of placement of the slices. It is also contemplated that for specific applications, the stacking conveyor 14 may be mounted on the slicing machine to permit its selective vertical adjustment to better accommodate particular operating conditions. The specific mounting and connections for enabling such vertical adjustment are not shown, but suitable mechanical connections are well-known to those skilled in this art as by providing movable plates or providing different mountings for the supporting rods 37. Similarly, the conveying system 13 is vertically positioned relative to the stacking conveyor such that the stacks of slices will be properly discharged and deposited into a package unit.

It is the function of the stacking conveyor to operate to cause its belt to reciprocate when in a functional mode for receiving the slices as they are severed from the product contained within the respective product receivers. This reciprocating movement of the stacking conveyor belt 36 is readily achieved through a mechanical interconnection with the product carrier 15. Such a mechanical interconnection for driving of the stacking conveyor belt 36 is illustrated in the drawings as comprising a sprocket chain 45 trained around a set of three idler sprocket wheels 46 and a drive sprocket wheel 47 with its ends being mechanically secured to the pendulum frame 22 by respective connectors 45*a*. The three idler sprocket wheels 46 are mounted on elements of the structural frame 11 with two being positioned on one element 48 in vertically spaced relationship and the other being mounted on a second one of such elements 49 and vertically spaced above the drive sprocket wheel 47. Support for the drive sprocket wheel 47 is provided by an auxiliary frame structure 50 which is secured to the one elongated side plate 38 of the stacking conveyor frame in outboard relationship thereto. Forming the auxiliary frame structure 50 are a pair of spaced parallel plates 51 that are interconnected by a plurality of support rods 52 which not only fix the two plates with respect to each other, but support those plates on the conveyor frame plate 38. A sprocket shaft 53 is journalled in the plates 51 and extends in axial alignment toward the drive shaft 44. The drive sprocket wheel 47 is mounted on the shaft and is in engagement with the chain 45 and is thus positioned between the two plates 51. Selective mechanical interconnection of the sprocket shaft 53 with the drive shaft 44 is effected through an electromechanical clutch mechanism 54. This clutch mechanism 54 has a structural housing which is mechanically secured onto the conveyor side plate and an internal mechanism which, when energized or de-energized, will perform the mechanical interconnection between the sprocket shaft 53 and the drive shaft 44.

Alternatively, driving of the stacking conveyor may be effected by an electric drive motor 55. This electric drive motor 55 is mounted on a supporting bracket structure 56 which is attached to the opposite conveyor frame side plate 38 and thus supports this motor in outboard relationship to the conveyor structure. Mechanical coupling of a drive shaft 57 of this motor to the conveyor drive shaft 44 is effected through a second electromechanical clutch mechanism 58. Again, electrical energization or de-energization of this clutch mechanism will result in mechanical coupling of the motor drive shaft with the conveyor drive shaft.

Figure 7:
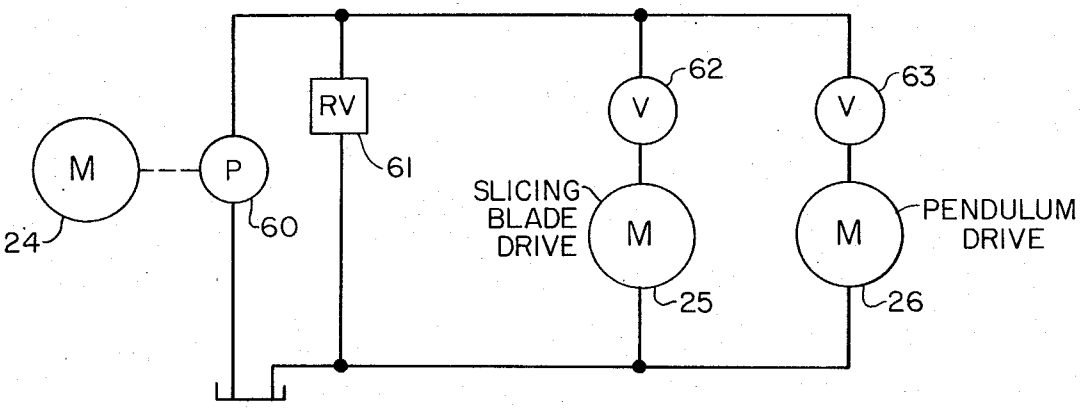
FIG. 7 is a schematic diagram of the hydraulic circuit for the first embodiment of the mechanism and associated slicing machine.

A basic hydraulic system for operation of the slicing machine is illustrated in the schematic diagram of FIG. 7. This hydraulic circuit includes the previously described pressurized fluid source comprising a pump 60 driven by the electric motor 24 and connecting with the fluid conduit system. A relief valve 61 is provided for the purposes of limiting the maximum pressure that may be developed within the system and to provide a bypass in those situations where the operating mechanisms are not functioning. Each of the two fluid drive motors 25 and 26 for operating the slicing blade mechanism 16 and the product carrier 15 are connected to the pressurized fluid conduits through respective control mechanisms. These control mechanisms are diagrammatically indicated to be control valves 62 and 63 that are connected in circuit with the respective motor 25 and 26. These valves are a type which may be manually set and function to control the fluid flow through the respective controlled circuit and thereby effect control over the speed of operation of the respectively connected components.

Figure 8:
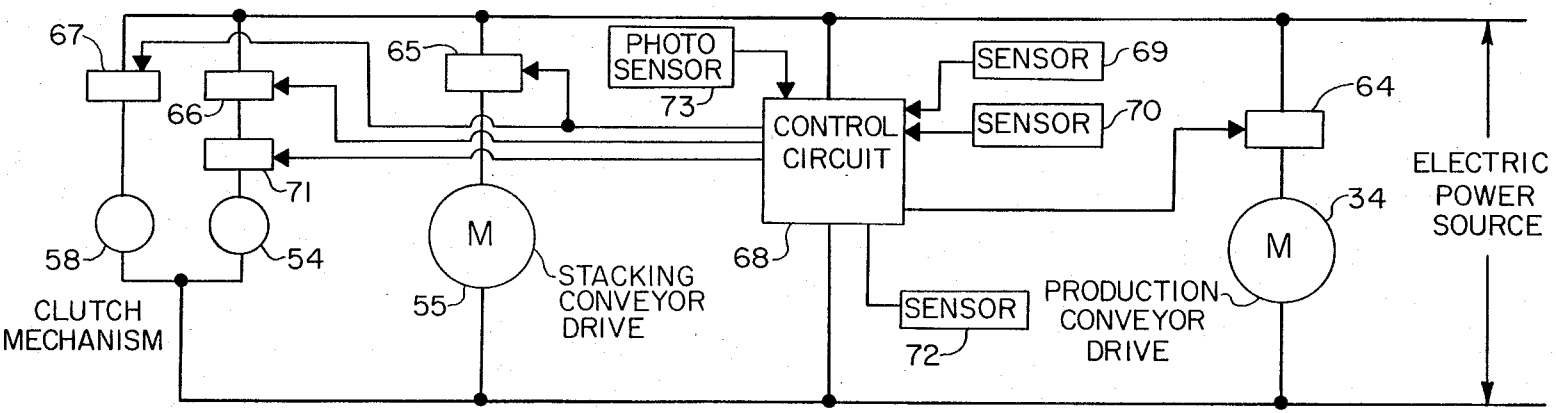
FIG. 8 is a schematic diagram of the electrical circuitry for the first embodiment of the stacking conveyor and slicing machine combination.

The conveying system 13 and the stacking conveyor 14 of the illustrative embodiment are electrically operated and are controlled in response to the operation of the slicing machine to function in accordance with the number of slices that are severed so as to sequentially produce stacks of slices of a predetermined number of slices. A typical control circuit for the operation of these components is illustrated in the schematic diagram of FIG. 8. Each of the production conveyor and stacking conveyor drive motors 34 and 35, respectively, are connected to a power circuit through respective switch mechanisms 64 and 65. Also connected in circuit with the electrical power system are the two electromechanical clutch mechanisms 54 and 58 that are associated with the stacking conveyor drive. Each of these two clutch mechanisms are selectively and alternatively interconnectable into the circuit for energization by respective switch mechanisms 66 and 67. Control of these components in the production conveyor 13 and the stacking conveyor 14 in this basic system is dependent upon the number of slices that are produced and deposited on the stacking conveyor and a primary control circuit 68 is provided in this system to provide a control input to each of the related operating components. The primary control circuit 68 in this illustrative embodiment includes an electronic counter circuit having a detector or sensor 69 for enabling the system to effect the counting of the slices that are produced. The sensor 69 may be a mechanically operated electrical switch such as a microswitch positioned as indicated in FIG. 2 to sense the oscillatory movement of the product carrier. Each displacement of the pendulum frame 22 in a cutting stroke will thus actuate this sensor 69 as the pendulum frame reaches its extreme forwardmost point which coincides with the severing of a slice. Operation of the sensor results in an input to the counter which is recorded and when a preset number of inputs are recorded, the counter in the primary control circuit 68 will function to provide a control signal to each of the switch mechanisms 64, 65, 66 and 67 to effect the operation of each respective component. In general, the functioning of the system is that the primary control circuit 68 will function at the desired point in time to actuate the switch mechanisms 66 and 67 for energizing the two respective clutch mechanisms whereby the sprocket drive will be disconnected from the stacking conveyor drive shaft 44 and the stacking conveyor motor 55 drive will be connected to that shaft. The switch mechanism 65 will be actuated at that point to energize the motor 55 and result in driving of the stacking conveyor belt 36 to effect advancement or discharge of the previously formed stack of slices. During the time of discharge of a stack of slices, the pendulum frame 22 will again be moving through a return stroke in preparation for a subsequent slicing stroke. At this point in the operating sequence, the sprocket drive clutch mechanism 54 is operated to disconnect the drive sprocket 46 and its shaft from the conveyor drive shaft 44, and thus, permit movement without interference as between the pendulum frame and the stacking conveyor. At the point in the reverse stroke where the pendulum frame 22 reaches the extreme limit of its return stroke, it will actuate a second sensor 70 such as a microswitch and thereby generate an input signal to the primary control circuit 68 and this input will then result in the control circuit 68 causing each of the switch mechanisms 65, 66 and 67 to be actuated to their positions whereby the respective stacking conveyor motor 55 and the electric motor drive clutch mechanism 58 will be de-energized and the sprocket drive clutch mechanism 54 is energized. The stacking conveyor belt 36 will then again be coupled to the sprocket chain and will be reciprocated by the oscillatory movement of the pendulum frame 22 in a reverse direction.

The basic generalized function of the stacking conveyor of this invention is that the stacking conveyor belt 36 is operated to cause its upper run to reciprocate in coordination with the movement of the pendulum type product carrier 15. Operation in accordance with this invention results in the stacking conveyor belt moving at the same velocity as the product slice during its formation, thereby effectively providing a receiving platform the for the slice that is relatively fixed in spacial relationship to the slice being formed. The specific objective that is achieved through this coordinated movement of the stacking conveyor belt and the food product slice is that the slice will be placed in a precisely predictable location on the stacking conveyor belt. The effect of any downward movement of the slice as would result from its cantilevered support during the forming operation is effectively eliminated as long as the limitation of spacing between the upper run of the stacking conveyor belt and the path of movement of the slice as it is formed is observed. As a consequence, successive slices can be stacked in vertical alignment with a high degree of precision since the conveyor belt is mechanically coupled to the product carrier 15 and will thus be displaced in accurate coordination with any food product slice as it is formed.

Operation of the stacking conveyor 14 has been described in its basic function of forming a stack of vertically aligned slices. However, with modification of the control circuitry to effect a slight alteration in the functioning of the components, the stacking conveyor 14 may be operated to stack several slices of the food product in a lapped or layered arrangement giving a shingled appearance to the stack. Modification of the electrical control circuit of FIG. 8 to enable the stacking conveyor to function in this manner comprises interconnection of a timing switch mechanism 71 in controlling relationship in the circuit including the electromechanical clutch mechanism 54 coupled with the chain drive sprocket 47. This timing switch mechanism 71 comprises an electrically operated switch and a timing element that is functional upon receipt of a signal to perform a timing function. The operation of the mechanism is that upon receipt of a signal such as an input from the primary control circuit 68, the switch contacts will be open to interrupt the circuit to the clutch mechanism 54 and initiation of the timing function. Upon completion of the timing interval, the switch mechanism 71 will then operate to close its contacts and again complete a circuit to the clutch mechanism 54 and enable the system apparatus to operate in the controlled manner by the chain drive to the pendulum product carrier. Preferably, the timing switch mechanism 71 is of a type enabling selective adjustment as to the time interval for purposes as will become clear with further description of its operation. When the product carrier 15 reaches the end of a cutting stroke, thereby actuating the microswitch sensor 69, the signal thus provided to the primary control circuit 68 will then be functional to result in application of a control signal to the timing switch mechanism 71. As a consequence, the timing switch mechanism 71 will function to open the circuit to the clutch mechanism 54 resulting in the mechanical disconnection of the sprocket chain drive to the conveyor. Although the product carrier 15 will immediately begin its return stroke, the stacking conveyor belt 36 will remain stationary until the time interval as determined by the timing switch mechanism will be determined and result in closing of that switch mechanism's contacts again resulting in energization of the clutch mechanism 54 and reconnection of the mechanical drive to the conveyor belt.

The effect of this functioning is that the conveyor belt 36 will be revolved in the reverse direction to a lesser extent, and thus, locate the slice that has just been placed on the conveyor belt in a relatively advanced position with respect to the normal starting position of the stacking conveyor belt. Accordingly, as the product carrier 15 begins its slicing stroke, the slice that is thus formed will be deposited onto the stacking conveyor in longitudinally displaced relationship to that preceding slice, thereby resulting in the stacking of the slices in longitudinally offset relationship. The extent of this longitudinal offset or layering of the slices to achieve the shingled effect is determined by the delay time introduced by means of the timing switch mechanism 71. Utilizing a timing switch mechanism that incorporates provisions for selective adjustment of the timed interval enables the apparatus to be adjusted in its operation to achieve any desired longitudinal offset of the respective slices. Once the stack of predetermined number of slices has been formed on the stacking conveyor 14, the operation will be as before described in discharging that stack onto the production conveyor 13.

Functioning of the stacking conveyor with this modified operation has been described in the forming of a layered stack that is formed in one direction. It will be apparent and readily understood that the operation may be further modified to effect stacking in a layered arrangement in the opposite direction. This may be accomplished such as by causing the timer mechanism 71 to function at the point where the product carrier 15 reaches the end of its return stroke and actuates the sensor 70. An input from the sensor 70 to the primary control circuit 68 may thus be utilized to initiate operation of the timing switch mechanism 71 to delay the beginning of the forward movement of the stacking conveyor belt 36 for a predetermined time interval in the same manner as described in the preceding functional operation. It will be understood, however, that the extent of the longitudinal displacement in this direction of layering is limited by the extent to which a slice may be formed before it is essential that the stacking conveyor belt be moving at the same rate of speed so as to begin receiving the slice and support the slice while the severing operation is completed.

During the discharge operation of the stacking conveyor 14, the conveying system 13 transporting the package units P is also activated to move the packaging unit in coordination with the movement of the stack of slices as it is discharged from the stacking conveyor. At the time that the stacking conveyor is operated to effect a discharge function, it will be seen from examination of FIG. 4 that the slice stack must be moved a predetermined distance before it will begin to enter the packaging unit. However, after the stack of slices begins to enter the packaging unit, it is highly desirable that the packaging unit then be moved at the same rate of speed to better facilitate the entry of the stack of slices into the packaging unit. Accordingly, the electrical control system may be designed to operate such that the motor 34 operating the conveyor system 13 will be energized in a delayed time sequence to that of the stacking conveyor in order that its movement will be coordinated with the location of the stack of slices and at the same rate of speed. In preparation for receipt of the next succeeding stack of slices, the conveying system 13 is designed to continue movement after it has received a stack of slices to preposition the next packaging unit P at the desired location at the discharge end of the stacking conveyor. This precise physical positioning of the next packaging unit P is accomplished by providing of a sensing device 72 capable of detecting the physical location of the packaging unit at the loading station. When the next succeeding packaging unit has arrived at this loading station, the sensor generates a signal which is applied to the primary control circuit 67 that then operates the switch mechanism 64 to de-energize the drive motor 34 of the conveyor system.

The embodiment of this invention has been described and illustrated as having a mechanism which counts the number of slices that are deposited on the stacking conveyor. Alternatively, the determination of the proper amount of food product that is sliced and deposited on the stacking conveyor can be determined by its weight. Conveyor mechanisms are frequently provided with electronic weighing devices which can accurately sense the particular weight of product that has been added to the conveyor and generate the necessary control signal for effecting operation of the associated components.

The apparatus as illustrated shows use of only one slicing mechanism for forming of the slices. Since a particular slicing machine has a maximum speed of operation as a consequence of mechanical motion limitations, such a single slicing station combination will then also have the same maximum rate of operation. To increase the production in a food processing system, two or more of the slicing machines 10 may be provided in a longitudinally spaced series. The operation of each of the slicing machines is synchronized so that each will simultaneously produce slices at its respective slicing point. With a multiple number of slicing machines, a single stacking conveyor 14 is provided, but is elongated relative to that illustrated to underly each of the slicing heads and to operate in unison therewith for receiving the slices as they are severed from the product contained in the respective product receivers. With this multiplication of slicing heads, a number of stacks of slices that are produced during a specific time interval are increased in direct proportion. Operation of the stacking conveyor at the conclusion of a stack forming operation wherein a predetermined number of slices are produced at each slicing station can be adjusted such that both stacks will be discharged during the time interval that the pendulum frames 22 are returning to the initial stroke position. Operation of the conveying system 13 is also modified to accommodate the discharge in succession of two stacks of slices. This modification of the conveying system operation is such that the operation is merely prolonged for the necessary time period to enable the two stacks to be discharged into their respective package unit.

As an alternative to operation of the plural slicing unit combination described in the preceding paragraph, this system may be utilized to produce stacks having a greater number of slices. The forming of the slices into a precisely aligned stack is enhanced when the receiving surface such as that of the stacking conveyor does not exceed a predetermined maximum distance below the point at which the slices are severed. This maximum distance for most products such as cheese or meat being formed into the customary relatively thin slices which may have a maximum thickness of $\frac{1}{8}$ inch is of the order of one inch or less. Consequently, the illustrative system has practical limitations in the size of the stack of slices that may be advantageously formed. However, an increase in the number of slices that are formed into a single stack may be readily accomplished by use of the stacking conveyor of this invention in combination with a plurality of the slicing machine as is the arrangement previously described. In that arrangement, the movement of the apparatus and particularly that of the stacking conveyor is such that the stacking conveyor will advance an incremental distance to place a stack that is formed by a first slicing machine to the slicing station of the second. The slicing machine at the second station is advantageously disposed at a relatively elevated position within the maximum vertical spacing criteria with respect to the top surface of the stack of slices received from the preceding unit and it is operated to concurrently slice and apply the same number of slices to the previously formed stack to thereby multiply the number of slices that are formed into a single stack. More than two slicing machines may be disposed in longitudinal alignment in this manner to further increase the number of slices that may be formed into a single stack. This multiplication of the number of slices into a stack does not result in a reduction in the rate of operation of this system from that of a single slicing machine. With a system of this type, appropriate sensing controls are provided to detect the position of the stacks of slices in order that the stacking conveyor may be incremented in a properly spaced relationship with respect to the distance of travel required as between the several slicing heads. For this purposes, a sensing device 73 in the form of a photo electric system may be provided to determine the position of the slice stacks on the stacking conveyor 14 and provide a control signal to the primary control circuit 68 which will, in turn, provide a control signal to the switch mechanism 65 controlling the stacking conveyor drive motor 55. Operation of the stacking conveyor will be substantially in accordance with the operation as initially described except that the conveyor drive motor 55 will only be operated for a time period that will result in incrementing the stacking conveyor belt 36 a distance to place a previously formed partial stack at the next slicing station with the operation of the motor being terminated upon generation of a signal by the photo electric sensing device 73. By having the distance from the completed stack to the discharge end of the conveyor less than the incrementing distance, the completed stacks may be discharged onto the production conveyor 13.

Figure 9:
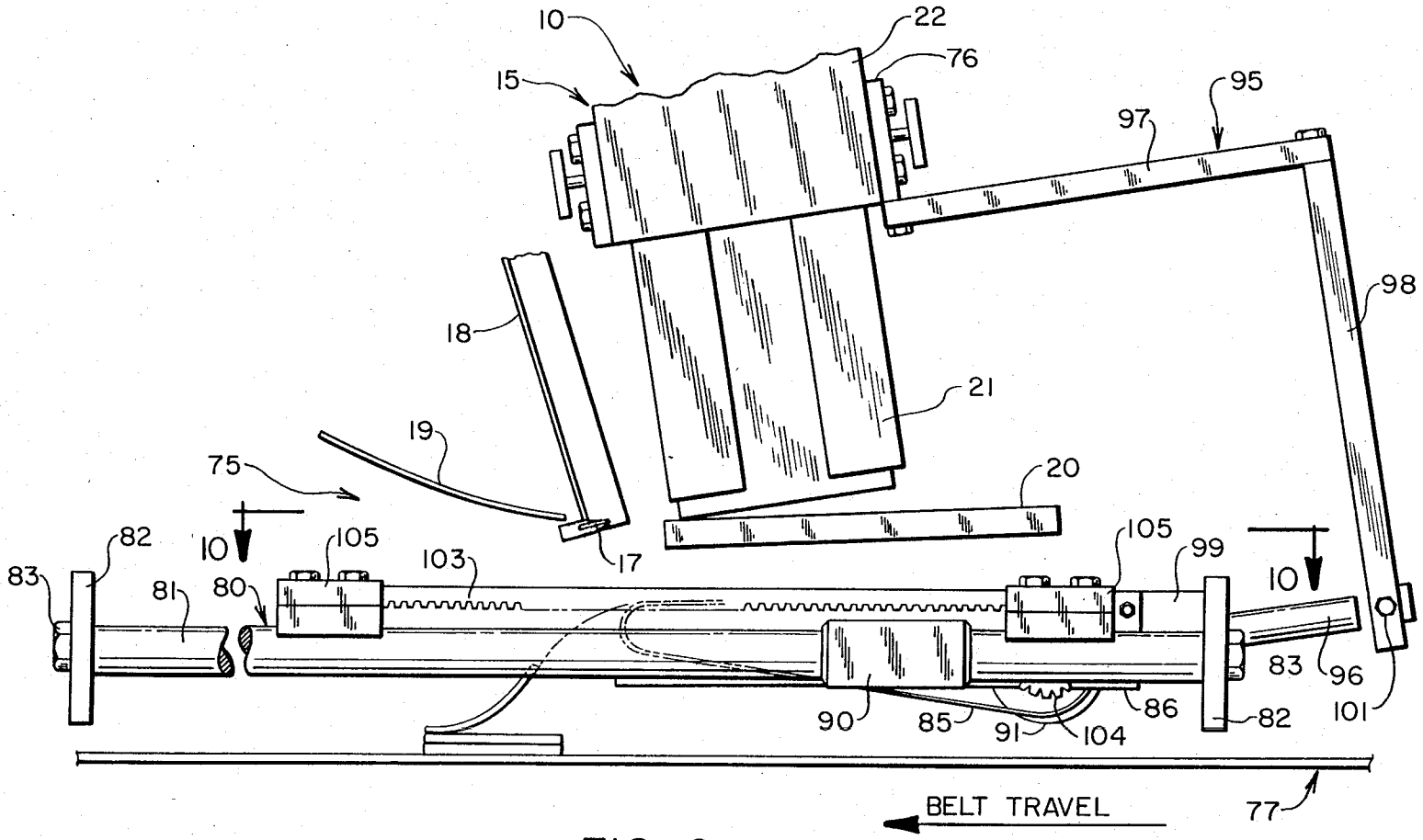
FIG. 9 is a side elevational view of a second embodiment of a stacking conveyor of this invention shown in association with a slicing machine and production conveyor in an arrangement similar to that of FIG. 3 with portions thereof broken away for clarity of illustration.
Figure 10:
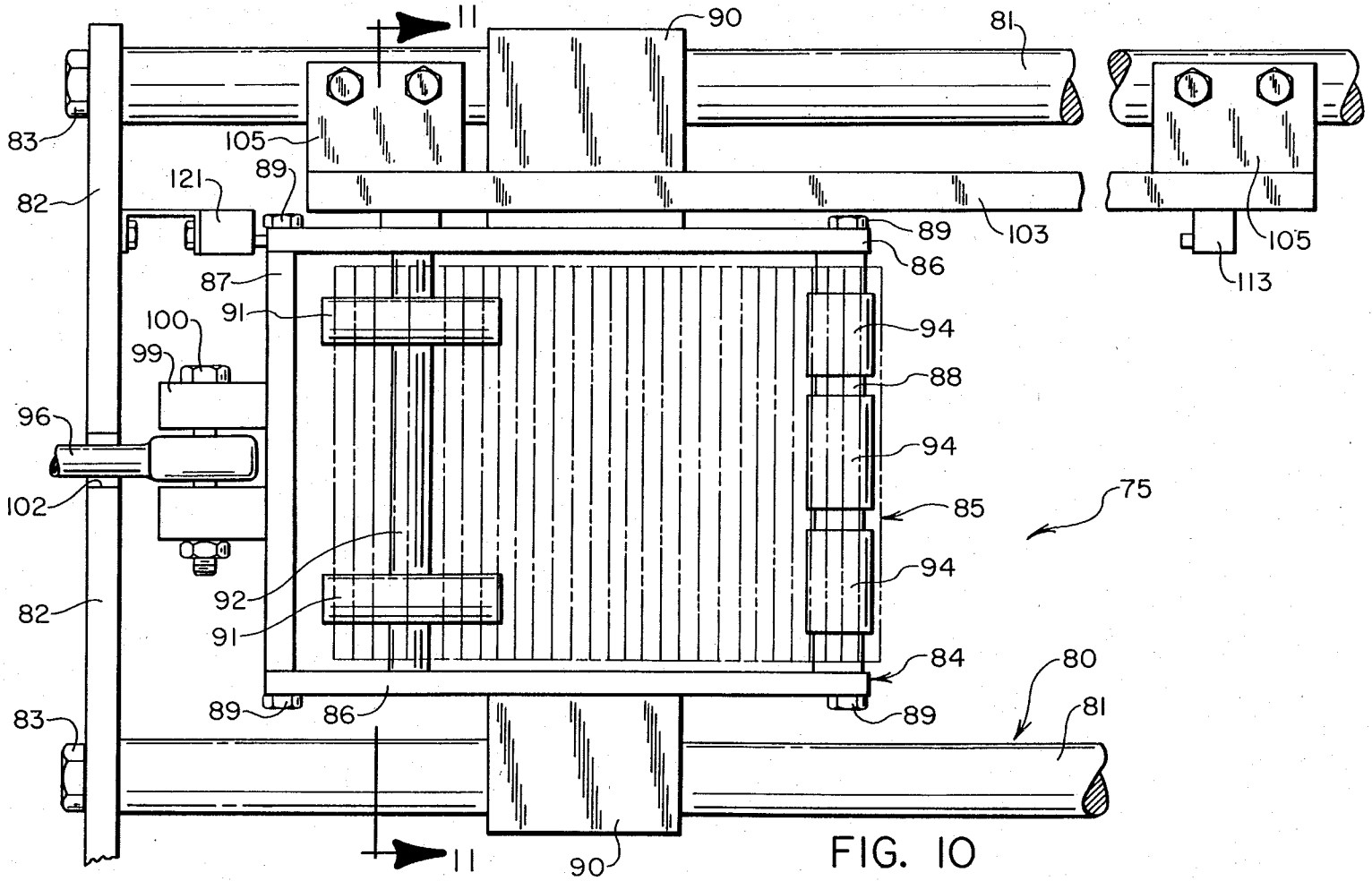
FIG. 10 is a fragmentary sectional view taken along line 10—10 of FIG. 9.
Figure 11:
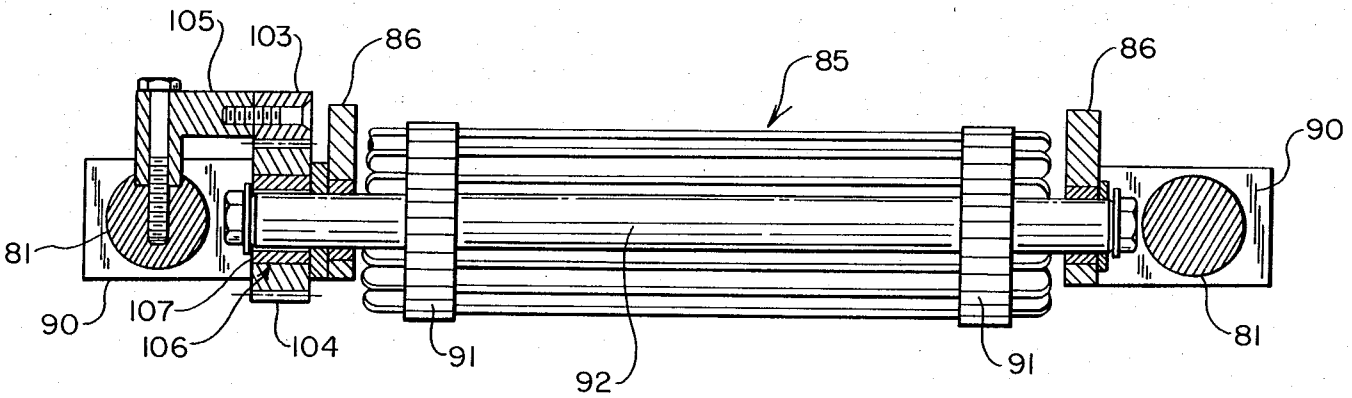
FIG. 11 is a sectional view taken along line 11—11 of FIG. 10.
Figure 12:
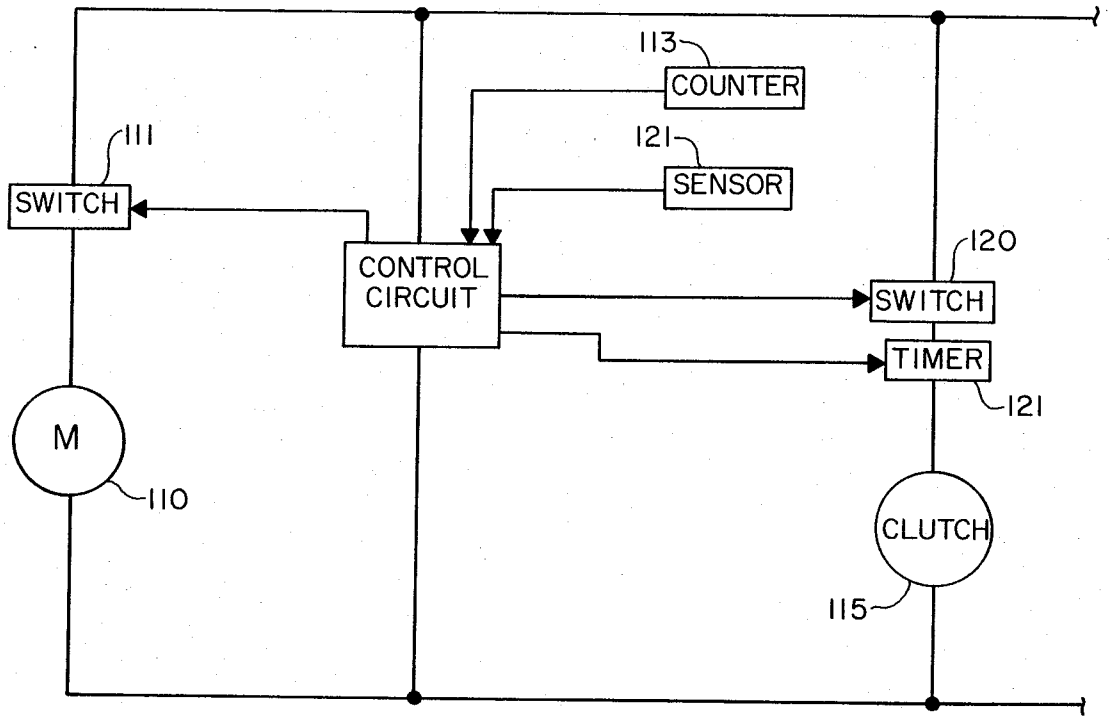
FIG. 12 is a schematic diagram of the electrical circuitry for the second embodiment of the stacking conveyor, slicing machine and production conveyor.

A second embodiment of a stacking conveyor 75 is illustrated in FIGS. 9, 10 and 11 of the drawings with FIG. 12 showing a typical electrical control circuit for utilization with this modification. This stacking conveyor 75 also achieves the basic objective of providing a relatively fixed receding surface onto which the food product slices are deposited from a slicing machine. Only a small portion of a slicing machine designated generally by the numeral 10 is illustrated in FIG. 9. The slicing machine 10 comprises the same structure as that previously described and illustrated in FIGS. 1, 2 and 3. Shown in FIG. 9 is a portion of the blade-type slicing mechanism 16 and its endless blade 17 along with a bottom portion of the product carrier 15. Also shown are the product support plates 19 and 20. The product carrier 15 includes a pendulum frame 22 which has secured to one side thereof a cross bar 76 which functions as a rigidifying element of that structure.

The stacking conveyor 75 is also shown positioned above in operative relationship with respect to a production conveyor 77 similar to that previously described, but having illustrated in FIG. 9 a fragmentary portion of the upper run of its conveyor belt. Structure and operation of the production conveyor 77 is substantially the same as that previously described and further description or illustration is not deemed necessary other than as may be specific to the functioning of this embodiment of the stacking conveyor.

Included in the stacking conveyor 75 is a primary support frame 80 which provides a means of attachment of the stacking conveyor onto the slicing machine 10. Forming the primary support frame 80 are a pair of elongated rods 81 disposed in spaced parallel relationship in a substantially horizontal plane. Interconnecting each end of the pair of rods 81 are respective mounting plates 82. These mounting plates are secured to the rods 81 by respective cap screws 83 and are of the length to extend a distance beyond the side of one of the elongated rods 81 to be rigidly secured such as by bolts to vertical components of the structural frame 11 of the slicing machine. The length of plates 82 is such that they will position the elongated rods 81 substantially symmetrically oriented with respect to the central longitudinal axis of operation of the slicing machine and result in location of the stacking conveyor 75 in proper relationship with respect to the product carrier 15. Mounted on the primary support frame 80 for reciprocating movement therealong is a secondary support frame 84 which in turn carries a stacking conveyor belt 85. The secondary support frame 84 includes a pair of spaced apart side plates 86 extending longitudinally with respect to the elongated rods 81 of the primary support frame and spaced a distance relatively inward thereof. Interconnecting the side plates 86 is an end plate 87 and a cross rod 88. The end plate 87 and cross rod 88 are rigidly secured to the side plates by respective cap screws 89, thus producing a rigid frame structure. Mounting of the secondary support frame 84 onto the primary support frame 80 is effected by a pair of support arms 90 that project a distance laterally in a horizontal plane from the outer side of the respective side plate 86 to which they are rigidly secured. Each of the support arms 90 includes a respective guideway through which a respective one of the elongated rods 81 extends. The guideways, while formed with a relatively close tolerance, are capable of sliding movement with respect to the rods 81. Thus, the secondary support frame 84 is capable of reciprocating movement along the rods 81 of the primary support frame.

The stacking conveyor belt 85 may be of a construction similar to that previously described and comprising a number of transversely extending wire rods that are interconnected at their opposite ends to form a link-type belt. Supporting the conveyor belt 85 are a pair of sprocket wheels 91 mounted on a drive shaft 92 extending transversely between the side plates 86 and journalled in bearings 93 carried by the side plates. Further support for the conveyor belt 85 is provided by cylindrical support sleeves 94 that are mounted on the cross rod 88. These support sleeves may be rotatable on that rod and are advantageously formed from a low friction material to enable the link-type belt to freely revolve around the surfaces. Each of the sprocket wheels 91 is mounted in fixed relationship onto the drive shaft 92 to be revolved as that shaft is rotated and to transfer that rotating motion to the conveyor belt 85.

Reciprocation of the secondary support frame 84 and stacking conveyor belt 85 carried thereon is effected through a mechanical interconnection with the pendulum frame 22 of the product carrier 15. Forming this mechanical interconnection is an L-shaped bracket 95 carried by the pendulum frame and a connecting rod 96 interconnecting the bracket 95 with the secondary support frame 84. The L-shaped bracket 95 includes a horizontal element which is secured at one end to the cross bar 76 and is of a length to project a distance substantially horizontally to position the vertical element 98 in rearwardly spaced relationship to the primary support 80 when the secondary support frame 84 is displaced to its initial starting position as shown in FIG. 9. The connecting rod 96 is pivotally connected to the lower end of the vertical element 98 of the bracket and is also pivotally connected to the end plate 87. The pivotal connection to the end plate is effected through a pair of mopnting brackets 99 by means of a pivot bolt 100. The opposite end of the connecting rod is connected to the bracket 95 by another pivot bolt 101. Clearance for operation of the connecting rod is provided by forming a notch 102 in the one mounting plate 82. With this mechanical interconnection the oscillatory swinging movement of the pendulum frame 22 will be transmitted to the secondary support frame 84. Thus, as the pendulum frame 22 swings in a clockwise direction from its initial starting position as shown in FIG. 9, the secondary support frame and stacking conveyor belt 85 will be reciprocated in a same forward direction in coordination with the carrier and thus maintain the conveyor belt 85 in an essentially stationary position with respect to the slice that is being formed. Thus, the conveyor belt will accomplish the desired objective as in the case of the first embodiment illustrated and described.

While the conveyor belt 85 is desired to be maintained stationary during the forward travel in receiving a food product slice as it is being formed, this embodiment of the stacking conveyor 75 is designed to discharge that slice immediately after it is completely formed and deposited on the conveyor belt. For this purpose, a drive mechanism is provided to effect rotation of the conveyor belt drive shaft 92 as a direct consequence of the reciprocating movement of the secondary frame on the primary frame. This revolution of the conveyor belt is obtained during the period of time that the secondary support frame 84 is displaced in a reverse direction in accordance with the return stroke of the product carrier's pendulum frame 22. As a consequence of the mechanical interconnection provided by the bracket 95 and connecting rod 96, the secondary support frame will be displaced in unison with the pendulum frame. Providing the mechanical interconnection to effect the revolution of the conveyor belt 85 is a rack and pinion gear mechanism. This mechanism includes an elongated gear tooth rack 103 mounted on one of the elongated rods 81 of the primary support frame 80 in fixed relationship thereto and a pinion gear 104. The gear tooth rack 103 is mounted on the elongated rod 81 by support blocks 105 that are bolted to the rod and project a distance inwardly to position the elongated rack 103 in spaced parallel relationship thereto. The inward spacing of the rack 103 is such that the rack will be located in relatively close proximity to the outwardly facing side of one of the side plates 86 of the secondary support frame 84. One end of the drive shaft 92 extends a distance outwardly with respect to that side plate 86 and carries on its outer end the pinion gear 104. In accordance with this embodiment of the invention, the pinion gear 104 is mounted on that shaft by a one-way clutch mechanism 106 which is of a mechanical operated type. This one-way mechanical clutch employs a well-known construction for such devices and includes an internal element 107 that is mounted on the drive shaft 92 in fixed relationship thereto and is operable to mechanically engage with the outer component integrally built into the pinion gear 104. The clutch is constructed and mounted such that as the secondary support frame 84 moves from the position shown in FIG. 9 to the left of that drawing figure, the pinion gear itself will freely rotate about the clutch mechanism without effecting rotation of the drive shaft 92. However, upon return movement of the secondary support frame, the clutch mechanism is operable to form a mechanical connection between the pinion gear and the internal element 107 to effect rotation of the drive shaft 92 so as to revolve the conveyor belt 85 in a counterclockwise direction as referenced to FIG. 9. This motion and operation thus results in the discharge of a slice that will have been previously deposited upon the conveyor belt during its forward displacement. The resultant effect is that the stacking conveyor belt 85 will discharge the slice at a predetermined position onto the upper run of the production conveyor belt 77. As each successive slice is formed, that slice will also then be deposited upon the belt and on top of the preceding slices that have been thus discharged, thereby resulting in the formation of a stack of the food product slices. In this embodiment, the production conveyor belt 77 will be maintained in a fixed position during the time that a stack of slices is produced as contrasted to the requirement that the production conveyor belt also be travelling in the same direction at the speed of discharge of the stack of slices in the case of the first described embodiment. Thus, a stacking conveyor 75 of this construction is particularly adaptable to a food processing system wherein the production conveyor belt 75 is of an intermittent drive type as a consequence of other processing operations that are performed on the food product slices. For example, in the case of a packaging operation where heat sealing is required, it is essential that the production conveyor belt be maintained stationary for a time period to effect the heat sealing. Consequently, there is sufficient time for the stacking conveyor 75 to function in cooperation with a slicing machine 10 of this type to form the desired number of slices into a stack.

Control for operation of the apparatus is schematically illustrated in the electrical circuit shown in FIG. 12. That circuit is of a simple typical type in which the production conveyor is provided with a drive motor 110 and having a control switch mechanism 111 interconnected in circuit therewith. A control circuit 112 is provided which is operable to provide an actuating electrical signal to the switch mechanism 111. The control function is the number of slices being formed into a stack, and thus, a counting device 113 is provided which may be in the form of an electrical microswitch mounted on the stacking conveyor to detect the cyclic movement of the pendulum frame 22. Consequently, upon completion of a complete cyclic stroke of the pendulum frame, the counting device 113 will be operable to generate a signal in the control circuit 112 and produce an operating signal to the motor switch mechanism 111. The time that this actuating signal is provided may be either determined by a timing device or other sensing means to ascertain the displacement of the production conveyor belt 77 for a predetermined distance. A sensing device for this latter purpose is not illustrated in the circuit shown in FIG. 12, but its function and operation will be readily understood.

Figure 13:
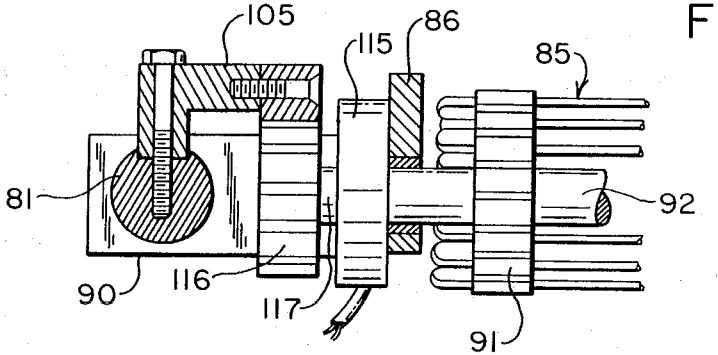
FIG. 13 is a fragmentary vertical sectional view of a modified conveyor belt drive mechanism.

A modification of the stacking conveyor 75 utilizes an electro-mechanical clutch mechanism in place of the relatively simple mechanical one-way clutch 106 of the embodiment as shown in FIG. 11. Referring to FIG. 13, the portion of the stacking conveyor as seen at the left side of FIG. 11 is shown with the incorporation of the electromechanical clutch 115. All other components that are of the same construction and function are numbered as previously described and the basic operation will be substantially the same in that the conveyor belt 85 will be maintained in relatively fixed relationship with respect to the slice as it is being formed and will be revolved to discharge a slice at the desired time in the operating sequence. The specific structure includes a pinion gear 116 carried on a shaft 117 that extends into the clutch 115. The internal components of the electric clutch are not illustrated, but are functional to engage and form a mechanical coupling between the shaft 117 and the shaft 92 which supports and drives the stacking conveyor belt 85.

This modified stacking conveyor utilizing an electromechanical clutch 115 may be operated in the same manner to perform the same functions as previously described. The clutch 115 is interconnected in the electrical circuit through a control switch mechanism 120 that is operated by application of a control signal produced by the control circuit 112. Operation is such that the clutch 120 is de-energized at the beginning of a slicing stroke, thereby enabling the pinion gear 116 to freely revolve as it rolls along the gear tooth rack 103 without driving the conveyor belt shaft 92. When the secondary support frame 84 reaches the furthest extent of its reciprocating movement in a left-hand direction as viewed in FIG. 9, the pendulum frame 22 engages with the counting device sensor 113 generating a signal to the control circuit 112 that is, in turn, then applied to the control switch mechanism 120 to result in energization of the clutch 115 and thereby effecting a mechanical interconnection between the pinion gear 116 and the conveyor belt drive shaft 92. Displacement of the secondary support frame 84 in a direction toward the right of FIG. 9 will thus, as a consequence of the pinion and rack gear engagement, rotate the drive shaft 92 and revolve the conveyor belt 85 to discharge the slice that was previously deposited on the upper run of the belt. When the pendulum frame 22 reaches the end of its return stroke, it engages with the second sensor 121 which is also mounted on the stacking conveyor and thus generates a signal to the control circuit to result in operation of the control switch mechanism 120 to effect de-energization of the electromechanical clutch 115. At this point, the stacking conveyor may be operated in a succeeding cycle to effect slicing and receiving of another food product slice.

The stacking conveyor 75 provided with the electromechanical clutch 115 may also be operated to form a stack of a plurality of food product slices on its upper run before discharge of the stack as a unit onto the underlying production conveyor 77. In this mode of operation, the counting device 113 not only detects the completion of a cutting stroke, but provides an input to the control circuit for effecting the counting of the slices that are to be formed into a stack. The control circuit in response to the counting signals then generates the necessary operating signals to the control switch mechanism 120.

As a further modified mode of operation of the stacking conveyor 75 provided with the electromechanical clutch 115, a timer switch mechanism 122 may also be connected into the power circuit to the clutch 115. The purpose of the timer switch is to enable the apparatus to function in a manner as previously described to effect a layering of the slices that are formed and deposited on the upper run of the conveyor belt. Operation of the apparatus utilizing the timer switch 122 enables the electromechanical clutch 115 to be energized or de-energized at a point intermediate the extreme limits of the reciprocating movement of the secondary support frame 84. To effect this layering function of a plurality of slices, the control circuit generates an operating signal to be applied to both the primary control switch 120 as well as to the timer switch 122. The timer switch 122 is of a type such as that previously described such that with application of the control signal, its contacts open to prevent energization of the clutch and initiate a timing cycle. The timing cycle is of a time period such that the timer switch contacts will close and result in energization of the clutch 115 at a predetermined point immediately prior to the time that the secondary support frame 84 reaches the extent of its travel in a return stroke direction. Thus, the pinion gear 116 will become mechanically coupled to the drive shaft 92 and cause revolution of the stacking conveyor belt 85 to displace a previously deposited food product slice a predetermined distance with respect to its initial starting point. Consequently, upon completion of the next slicing stroke, the succeeding slice will be deposited in a longitudinally displaced position with respect to the preceding slice. Subsequent slices are similarly deposited in longitudinally spaced relationship to produce the layered configuration of the stack. Once the stack of predetermined slices is formed, the system then returns to the operation to effect a complete discharge of the stack from the stacking conveyor onto the production conveyor.

A layered stack of slices may also be formed by either of the two illustrative embodiments of the stacking conveyor 14 or 75 in a cooperative mode of operation with its respective production conveyor 13 or 77. This type of stacking can be accomplished by operating the stacking conveyor to discharge each slice immediately after its formation, but incorporating a drive and control in the combination to increment the production conveyor to obtain a relative longitudinal displacement as between successive slices. This mode of operation is readily achieved with the stacking conveyor 75 illustrated in FIGS. 9–11 by utilizing the signal generated by the sensor 121 denoting completion of the product carrier and conveyor return stroke to also operate the drive motor 110 of the production conveyor 77 for an interval of time to effect the incrementing for a predetermined number of slices and, when the stack is formed, the production conveyor is then advanced to receive a next stack of layered slices. The incrementing of the production conveyor may be effected in either a forward or reverse direction. With the first illustrated and described embodiment of the stacking conveyor 14, the incrementing of the production conveyor belt 30 must be accomplished in a reverse direction only since it is necessary that the production conveyor belt must travel the same distance as the length of the slice in receiving each slice.

It will be readily apparent from the foregoing description of the illustrative embodiments of this invention that a particularly novel and advantageous apparatus is provided for forming of stacks of slices produced by a slicing machine such as a pendulum type of slicer. Utilization of the stacking conveyor operated in coupled relationship to the movement of the slicing machine results in the severed slices being deposited at a precise point on the conveyor and thus forming a properly aligned stack of slices.

Having thus described this invention, what is claimed is:

1. A stacking apparatus for vertically stacking a plurality of relatively thin, flexible sheet-form product slices disposed in coplaner relationship to a substantially horizontal plane and moving in series along a generally horizontally disposed path and gravity deposited at a receiving station into a stack of slices of predetermined superposed configuration comprising a stacking conveyor positionable at the slice receiving station and having a conveyor belt supported for displacement in longitudinal alignment with the path of movement of the product slices, said belt having an upper run forming a slice receiving surface disposed in a substantially horizontal plane underlying the path of movement of the product slices to be received thereon, the upper run of said conveyor belt being selectively displaceable in said horizontal plane along a path aligned with the path of movement of the slices, and drive means operatively coupled with said conveyor belt responsive to a slice being deposited on said conveyor and operable for selectively displacing said conveyor belt to reciprocably displace the upper run thereof from a first position to a second position where the slice being deposited is fully received thereon in a same direction as that of a gravity-fed slice being deposited thereon at substantially the same horizontal velocity of the slice being received whereby the receiving surface is maintained essentially stationary with respect to the moving slice while the slice is being received and to then displace the upper run thereof in the opposite direction to a predetermined position relative to said first position for receiving thereon a next successive gravity-fed slice in superposed stacked relationship to the previously received slice, said drive means alternatively selectively operable in response to a predetermined number of slices having beeen deposited thereon in a formed stack for displacing said conveyor belt upper run to discharge a formed stack of product slices from the conveyor.

2. A stacking apparatus according to claim 1 wherein said conveyor belt is supported with its slice receiving surface disposed not more than a predetermined maximum distance below the path of movement of a slice at said first position whereby a slice will be received in a primarily horizontally planar configuration.

3. A stacking apparatus according to claim 1 wherein said drive means includes selectively operable coupling means for interconnecting said belt in driven engagement with apparatus displacing a slice at the receiving station whereby said conveyor belt will be displaced at the same velocity as the slice.

4. A stacking apparatus according to claim 3 wherein said conveyor belt is supported for revolution on a frame structure which is disposed in a fixed position and said drive means is operative to revolve said belt while a slice is being received thereon.

5. A stacking apparatus according to claim 4 wherein said drive means includes a drive motor and second selectively operable coupling means for interconnecting said belt in driven engagement with said drive motor, and which includes control means operative in response to input of control signals thereto to alternatingly operate said coupling means whereby said conveyor belt will be driven either by said drive motor or by apparatus displacing a product slice.

6. A stacking apparatus according to claim 1 wherein said conveyor belt is supported on a frame structure which is reciprocable along a rectilinear path and is mechanically coupled with apparatus displacing a product slice at the receiving station, and said drive means includes means selectively engageable with said conveyor belt to effect revolution thereof in response to displacement of said frame structure.

7. A stacking apparatus according to claim 1 which includes a production conveyor disposed in underlying relationship to said stacking conveyor for receiving thereon product slices discharged from said stacking conveyor.

8. In combination with the stacking apparatus of claim 1, a product slicing maching having a support frame, a blade-type slicing mechanism mounted on said frame and positioned above said stacking apparatus and including an operative portion of a slicing blade extending substantially horizontally in a direction transverse to the direction of movement of the conveyor belt of said stacking conveyor, and a product carrier mounted on said frame for oscillatory movement in a vertical plane aligned with the direction of movement of said conveyor belt for displacing food product with respect to the operative portion of said slicing blade in repetitively producing product slices moving along a rectilinear, horizontal path.

* * * * *